United States Patent [19]

Jaisinghani et al.

[11] Patent Number: 4,940,470

[45] Date of Patent: Jul. 10, 1990

[54] SINGLE FIELD IONIZING ELECTRICALLY STIMULATED FILTER

[75] Inventors: Raian A. Jaisinghani, Midlothian; Neville J. Bugli, Richmond, both of Va.

[73] Assignee: American Filtrona Corporation, Richmond, Va.

[21] Appl. No.: 172,160

[22] Filed: Mar. 23, 1988

[51] Int. Cl.[5] ..... B03C 3/00

[52] U.S. Cl. ..... 55/2; 55/131; 55/132; 55/138; 55/151; 55/521

[58] Field of Search ..... 55/131, 132, 138, 521, 55/2, 151

[56] References Cited

U.S. PATENT DOCUMENTS

| | | | |
|---|---|---|---|
| 2,297,601 | 9/1942 | Williams | 183/7 |
| 2,973,054 | 2/1961 | Kurtz | 183/7 |
| 3,108,865 | 10/1963 | Berly | 55/131 |
| 3,242,649 | 3/1966 | Rivers | 55/132 |
| 3,537,238 | 11/1970 | Dungler | 55/131 |
| 3,763,633 | 10/1973 | Soltis | 55/126 |
| 3,798,879 | 3/1974 | Schmidt-Burbach et al. | 55/102 |
| 3,871,851 | 3/1975 | Neumann | 55/521 |
| 3,973,932 | 8/1976 | Alskog | 55/132 |
| 3,981,695 | 9/1976 | Fuchs | 55/138 |
| 3,997,304 | 12/1976 | Carr | 55/147 |
| 4,052,177 | 10/1977 | Kide | 55/139 |
| 4,133,649 | 1/1979 | Milde | 55/2 |
| 4,244,710 | 1/1981 | Burger | 55/6 |
| 4,261,712 | 4/1981 | Kinkade | 55/126 |
| 4,279,625 | 7/1981 | Inculet et al. | 55/131 |
| 4,313,739 | 2/1982 | Douglas-Hamilton | 55/2 |
| 4,357,150 | 11/1982 | Masuda et al. | 55/6 |
| 4,507,131 | 3/1985 | Fathauer et al. | 55/104 |
| 4,509,958 | 4/1985 | Masuda et al. | 55/132 |
| 4,549,887 | 10/1985 | Joannu | 55/131 |
| 4,750,921 | 6/1988 | Sugita et al. | 55/132 |
| 4,781,736 | 11/1988 | Cheney et al. | 55/132 |

FOREIGN PATENT DOCUMENTS

| | | | |
|---|---|---|---|
| 821315 | 8/1969 | Canada | 183/7.8 |
| 821900 | 9/1969 | Canada | 183/7.8 |
| 46-599 | 8/1971 | Japan | 55/131 |
| 53-112578 | 10/1978 | Japan | 53/124 |
| 892908 | 1/1962 | United Kingdom . | |
| 2097292 | 11/1982 | United Kingdom . | |
| 2130922 | 6/1984 | United Kingdom . | |

OTHER PUBLICATIONS

C. N. Davies, *Air Filtration,* Academic Press, New York, 1973, pp. 52–59, 84–95, 102–107.

W. Bergman, et al., "Electric Filtration: Theory, Laboratory Studies, Hardware Development, and Field Evaluations", Lawrence Livermore Nat'l Laboratory, 1984, pp. 99–107, 168.

R. Jaisinghani, et al., "Effect of Relative Humidity on Electrically Stimulated Filter Performance", APCA Journal, vol, 37, No. 7, Jul. 1987, pp. 823–828.

Jaisinghani, R. A., et al., "Performance Characteristics of a Two Electrode Ionizing Electrically Stimulated Filter", paper presented at the Symposium on Contamination Control and Clean Room Technology, 19th Annual Meeting of the Fine Particle Society, Jul. 1988, Santa Clara, CA, 36 pp.

*Primary Examiner*—Bernard Nozick

*Attorney, Agent, or Firm*—Fleit, Jacobson, Cohn, Price, Holman & Stern

[57] ABSTRACT

A single field ionizing electrically stimulated filter utilizing a non-conductive filter medium is charged by an electric field created between an ionizer space-apart from the upstream face of the filter media and an electrode placed in close proximity with the downstream face of the filter media. The ionizer and electrode are respectively supplied with differing high voltage potentials. For optimum efficiency, the electrode at least loosely contacts the downstream face of the filter media. HEPA glass filter media in sheet form is pleated and sealingly mounted in a nonconductive frame, with the pleats spaced apart by non-conductive spacer means applied across the filter media faces. The ionizer includes a plurality of ionizer wires extending across a nonconductive frame and spaced back from the frame's downstream face so that gap is maintained between the ionizer wires and the filter medium. The filter produces a single ionizing electric field which charges incoming particles and produces and maintains a charge differential between the upstream and dowstream faces of the filter medium for enhancing filtration efficiency.

31 Claims, 10 Drawing Sheets

102'

SINGLE FIELD IONIZING ELECTRICALLY STIMULATED FILTER

BACKGROUND AND SUMMARY OF THE INVENTION

This invention relates to filters and filtration generally, and more particularly to that type of filter known as an electrically stimulated filter (ESF), that is, the type of filter wherein the particulate-filtration efficiency of a mechanical filter is enhanced electrically. Electrically stimulated filters are attractive because they result in lower flow restriction and/or higher flow rate per filter area, with generally higher contaminant-holding capacity in comparison with purely mechanical filters of similar efficiency.

Many of the conventional electrically stimulated filters have in common the aspect of utilizing separate ionizing (charging) and collecting electrical fields. Examples of such conventional devices are found from U.S. Pat. Nos. 3,798,879 and 4,357,150 as well as from Canadian Pat. No. 821,900. Another device of this type is disclosed in co-pending U.S. patent application Ser. No. 48,452 of Jaisinghani et al filed May 11, 1987, the disclosure of which is hereby incorporated by reference herein.

Conventional two-field (i.e., separate ionizing and collecting electrical field) devices typically require from 3–5 electrodes, with two of the electrodes being maintained at high voltage. Additionally, some devices utilize only a single electrical field, which is either an ionizing field for charging particles, or an electrical field for polarizing or charging the filter material. U.S. Pat. No. 4,357,151 discloses an example of a filtration device relying solely on charging particles and collecting the charged particles on a non-electrified filter (collector). U.S. Pat. No. 2,297,601 discloses an example of a device which relies primarily on polarizing the filter material and not charging the incoming particles, although it is also disclosed that the device can be used with a separate ionizing field.

The present invention is concerned with utilizing a single high voltage electrical field for enhancing the filtering efficiency of a non-conductive filter medium. The single high voltage electrical field is used both to charge the incoming particles and to charge and polarize the filter medium. Thus, in comparison to a conventional non-electrified mechanical filter having the same filtration efficiency, the electrically stimulated filter of the present invention provides a significant advantage in flow rate, pressure drop and contaminant holding capacity or life, for a given amount of filter material.

Furthermore by the single field electrically stimulated filter of the present invention, these advantages may be obtained more economically, due to the utilization of only one electrical field, and to the requirement for only one high voltage electrode, as compared to the conventional two-field electrically stimulated filters. Furthermore, the single field ionizing electrically stimulated filter according to the present invention provides enhanced filtering efficiency at lower power consumption, that is, at approximately the same power consumption as in the conventional two-field ESFs, higher efficiency enhancement is possible in accordance with the present invention.

The method and apparatus of the present invention provide ionizing electrically stimulated filtration and thus may be referred to as providing an ionizing electrically stimulated filter (IESF). The principal of operation of the IESF according to the present invention is depicted schematically in FIG. 1. A non-conductive porous/fibrous filter "F" is placed within an ionizing field. The ionizing field may typically be achieved by the use of thin ionizer wires "W" spaced apart and maintained at a high potential. The non-conductive filter media "F" is placed between the high voltage wires "W" and a flat perforated electrode "E" of opposite polarity, typically at ground potential, as shown in FIG. 1.

The non-conductive filter material "F", being a dielectric, tends to suppress the field ionization in comparison to the field ionization that would occur without the presence of the filter medium dielectric. However, some ionization still occurs due to the porous nature of the filter medium. This lower level of ionization, however, is still sufficient to adequately charge incoming comtaminant particles. Charged comtaminant particles and ions collect on the upstream side of the filter material "F", producing a differential charge and potential across the filter medium "F". Since the filter medium "F" is non-conductive, these induced charges dissipate very slowly.

Also, due to the presence of the non-conductive filter medium "F" within the ionizing electrical field, there is always a potential difference maintained across the filter medium "F" independent of the amount of captured charged particles on the upstream side. This potential difference depends on the potential applied to the ionizer wires, "W", and on the surface and volume resistivity of the filter medium "F". Thus, a highly non-conductive filter medium is to be preferred. Best results are obtained when the downstream side of the non-conductive filter medium "F" is in contact with the perforated ground electrode "E". Filter media contact or close proximity with the ionizing wires or ionizing electrodes "W" must be avoided at all costs, since such contact or proximity tends to almost completely suppress the ionization, and thus tends to reduce the device to operating solely as a simple polarized filter medium.

Another aspect of the IESF according to the present invention is that the dielectric constant of the filter media also affects the filter's performance. Higher dielectric values result in increased particle capture due to dielectrophoresis (i.e., the interaction of polarized contaminant particles and the polarized fibers of the filter medium). However, higher dielectric value materials also tend to have higher conductivity, and this tends to lower the potential difference which is obtained across the filter medium and thus lower the efficiency enhancement which is obtained from electrical stimulation. We have found that typically greater than $10^{12}$ ohm-cm value resistivity is preferred and that this can be achieved with filter media having a dielectric constant of typically between 2–5. Preferably, glass fibers of resistivities between $10^{13}$–$10^{16}$ ohm-cm are utilized, although other materials such as polypropylene and polyester and the like can be used.

The filter medium should also be able to withstand some level of corona discharge and not ignite in the electrical environment. The severity of this aspect of the electrical environment depends on the applied field strength and on the gap "g" between the ionizing wires "W" and the non-conductive filter medium "F". The smaller the gap "g" and the higher the applied field strength, the greater is the necessity that the filter medium "F" be resistant to the corona discharge. When the ionizing Wires "W" touch the filter "F" or are in too close proximity thereto, almost all common filter media fail at all practical applied field strengths (i.e , field strengths required for adequate ionization). Thus, it is very important to maintain a gap between the ionizing wires and the filter medium.

U.S. Pat. No. 2,973,050 discloses a gas cleaning filter that does utilize a single electrical field. However in this device it is required that the collecting medium be conductive. As noted above, if the collecting medium is conductive, then potential difference which can be obtained across the filter medium drops markedly, i.e., to zero for a metal conductor as described in this prior patent, and the efficiency enhancement of the device will also drop. The device according to this prior patent operates as an ionizing-only field device where the electrical enhancement is due to the interaction of charged particles with an uncharged non-polarized filter medium.

However, it is well known that the interaction between charged and polarized particles and charged/-polarized filter media is significantly higher than the interaction of charged particles with an uncharged non-polarized filter medium, as has been described previously in C N. Davies, "Air Filtration", Academic Press, New York (1973). Further, it is well know that the interaction between charged and polarized particles and charged and polarized filter media is significantly higher than the interaction of uncharged, polarized particles and polarized filter media. In particular the interaction between charged and polarized particles and charge polarized filter medium has only been achieved previously by the two-field ESF devices, and may now advantageously be achieved more efficiently by the IESF method and apparatus according to the present invention.

U.S. Pat. No. 4,244,710 also discloses a filter unit utilizing only a single electrical field, but requires the utilization of a charcoal filter. Since charcoal is highly conductive (being neither a non-conductor nor a dielectric), this use of charcoal as a filter media closely corresponds to the use of the conductive filter media in the device disclosed in U.S. Pat. No. 2,973,054 as discussed above.

Another single field device is described from U.S. Pat. No. 3,763,633. In this prior device, it is required that the "ionizing" electrode make contact with or be in close proximity to the filter medium. More particularly, in this prior device it is required that the filter medium "dielectric foam" be sandwiched between the "ionizing" wires and the ground electrode. In particular in this prior device the dielectric foam filter media which sandwiches the high potential electrode screen is also compressed in contact against a conductive foil prefilter which in turn is in electrical contact with a front ground electrode. However, as discussed above, such filter medium-ionizing electrode contact greatly reduces the ionization and filter polarization and reduces the enhancement mechanism to that of a device relying solely on the interaction between uncharged particles and polarized filter medium, without charging the particle. Furthermore, the device of this prior disclosure is intended to be used with significantly thick fibrous mat filter media. However, in most high efficiency filtration applications HEPA glass filter media is used for the removal of submicron size particles. This HEPA filter media is provided in sheet form having thicknesses of typically less than 0.5mm.

HEPA media in sheet form is very dense compared to glass-fiber mats, and this greater density tends to suppress ionization drastically, especially when the ionizer is in close proximity to the filter medium. Thus, the device described in U.S. Pat. No. 3,763,633 wherein the ionizer is in close proximity to the filter medium offers no significant advantages over the purely mechanical filtration efficiency, as has been shown from the results of evaluations in several cases as set forth in Table 1.

With reference to Table 1, a HEPA glass filter medium was utilized in a flat sheet form and evaluated for the following cases Case (a): No applied electrical fields, (mechanical efficiency only being evaluated);

Case (b): Ionizing wires placed in close proximity to the HEPA medium, with a ground electrode placed in loose contact with the filter (equivalent to the device of U.S. Pat. No. 3,763,633);

Case (c): No ionizer utilized, but with filter medium sandwiched between two perforated electrodes in close proximity/loose contact with the filter medium, with one electrode maintained at high potential and the other electrode grounded ("equivalent" to an ESF without ionizing precharger);

Case (d) Ionizer in close proximity with the filter medium, and a ground electrode spaced 0.75 inches distant from the filter medium (somewhat similar to the device of U.S. Pat. No. 3,763,633); and Case (e) single field ionizing electrically stimulated filter (IESF) according to the present invention, having a ground electrode in loose contact with the filter medium, and an ionizer spaced approximately 0.75 inches away from the filter medium.

Each of the cases (a)–(e) was evaluated at a fixed flow velocity of 66.6 feet/minute and at various applied voltages. The results are shown in Table 1.

TABLE 1

| Case | Voltage KV | Current mA | Efficiency at 0.3 m DOP |
|---|---|---|---|
| (a) | N/A | N/A | 67% |
| (b) | 2.5 | 0 | 72% |
| (b) | 11 | 0.22 | 71.2% |
| (c) | 2.5 | 0 | 69% |
| (c) | 6.25 | 0 | 74% |
| (d) | 11 | 0.002 | 73% |
| (e) | 11 | 0.18 | 99.3% |

From the results in Cases (b), (c) and (d), it may be seen that those arrangements according to the prior art do not offer any significant advantage over solely mechanical filtration when using an HEPA filter medium as in Case (a). From comparing Cases (b) and (c), it may be seen that the ionization is totally supressed by the proximity of the HEPA filter medium. The ionizer wires in Case (b) do not provide any enhancement over Case (c) utilizing the simple polarized media and non-ionizing perforated metal electrodes. Further, it is clear that even when the ground electrode is spaced apart from the media as in Case (d), the ionization is still supressed by the proximity of the filter medium to the ionizer wires, and thus little enhancement in 0.3 um DOP efficiency results. The significant enhancement achieved by the IESF of the present invention may be seen from comparing the 99.3% efficiency in Case (e) to the 71–73% efficiency in Cases (b) and (d).

Thus, we have found that the provision of a significant gap "g" between the ionizer and the filter medium is critical for enhanced efficiency. The single field ionizing electrically stimulated filter according to the present invention can conveniently use pleated or convoluted filter media. In this case, the ground electrode is placed in contact with or in close proximity to the downstream peaks of the filter medium while the ionizer wires are spaced away from the opposite peaks of the pleated media by the gap "g" as shown in FIG. 1. Such a configuration derives full benefit from the increased surface area presented to the flow by a pleated filter. Typically approximately 20,000–30,000 volts (KV) are applied when using a filter medium having 1.75–2" deep pleats with a total electrode separation of about 2.5–3". Such an arrangement results in an efficiency enhancement from about 50% (for a mechanical filter without any electrical field) to about 97–99% using 0.3 um DOP particles. Such an enhancement in efficiency is not possible with the conventional two-field ESF devices. For example, at practicle applied power levels, the enhancement of the device disclosed in copending U.S. patent application Ser. No. 48,452 utilizing two fields is 97–99% when using a media of mechanical (no electrical field) efficiency of 65–70%.

Thus, we have found that the single field ionizing electrically stimulated filter according to the present invention provides the advantages of significantly enhanced filtration efficiency over the prior single and two-field electrically stimulated filter devices, and provides these advantages at significant economies over the prior devices.

BRIEF DESCRIPTION OF THE DRAWINGS

A practical embodiment of the single field ionizing electrically stimulated filter according to the present invention is described in the following detailed description with reference to the accompanying drawings in which.

DETAILED DESCRIPTION OF THE INVENTION

A practical embodiment of the single field ionizing electrically stimulated filter (IESF) according to the present invention is illustrated in FIGS. 2–8. It is emphasized that this disclosed embodiment is illustrative of a particular application of the IESF according to the present invention, and that the essential features of the present invention may be embodied in various other practical applications without departing from the principle of operation and scope of the invention.

Figure 1:
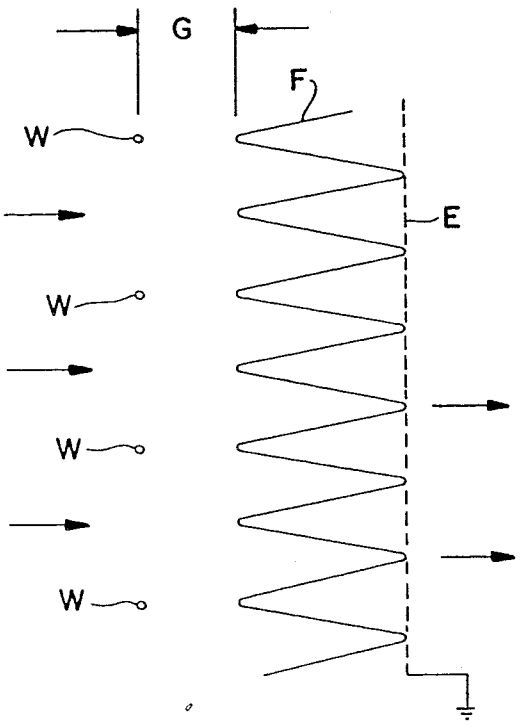
FIG. 1 is a schematic depiction of an IESF according to the present invention.
Figure 2:
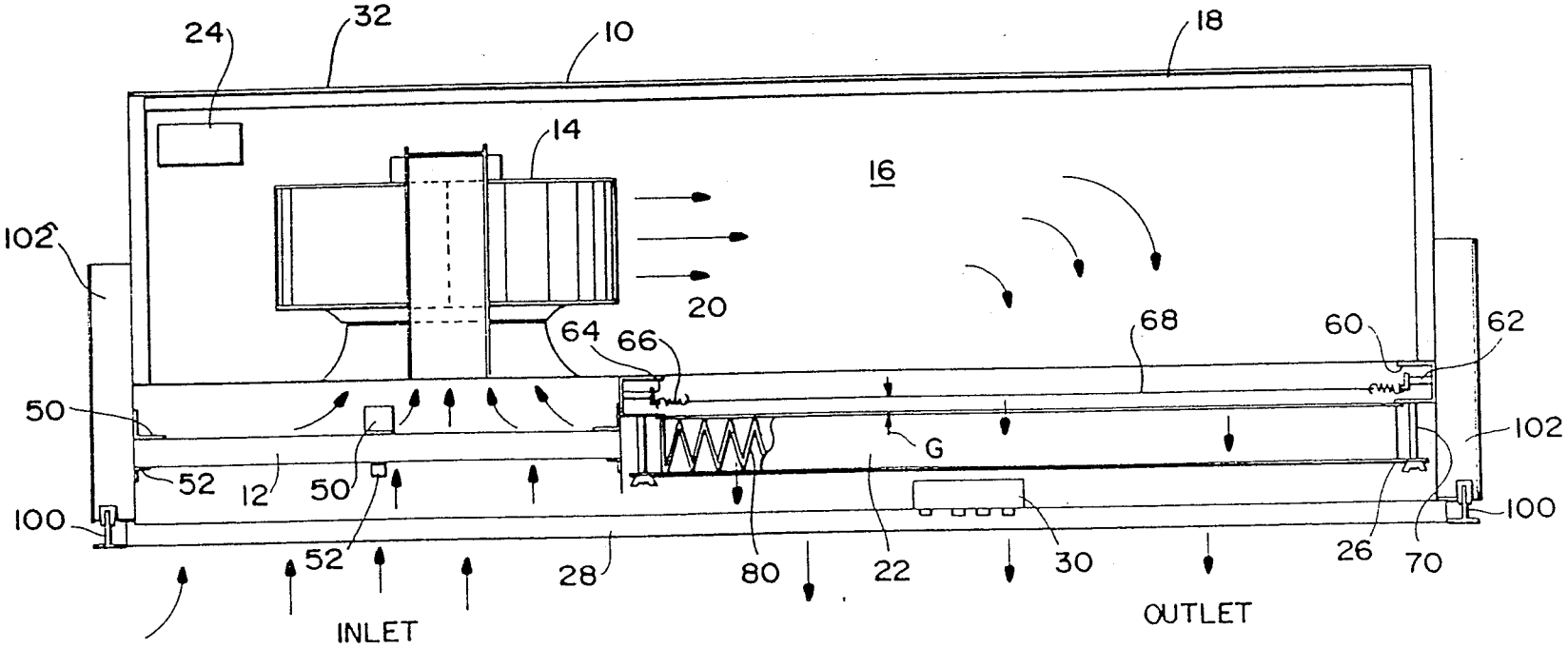
FIG. 2 is a side elevation sectional view of the IESF according to the present invention embodied in a self-contained filtration unit.

With reference to FIG. 2, there is shown a self-contained HVAC version of an IESF suitable for ceiling mounting in a room, restaurant, bar or the like.

The contaminated intake air is drawn into the IESF housing 10 through a prefilter 12 at the intake. A blower or fan 14 draws the air in from the intake through the prefilter 12 and discharges the pre-filtered air into a plenum compartment 16 which is preferably lined with acoustical foam 18. The plenum compartment 16 directs the air to an ionizer assembly 20. The air passes through the ionizer 20 and then through a pleated media filter element 22 which is placed within the ionizing electric field of the ionizer assembly 20. The ionizer assembly 20 is supplied with high voltage DC power from a power supply 24, so that the ionizer 20 provides a single high voltage electrical field.

Figure 9:
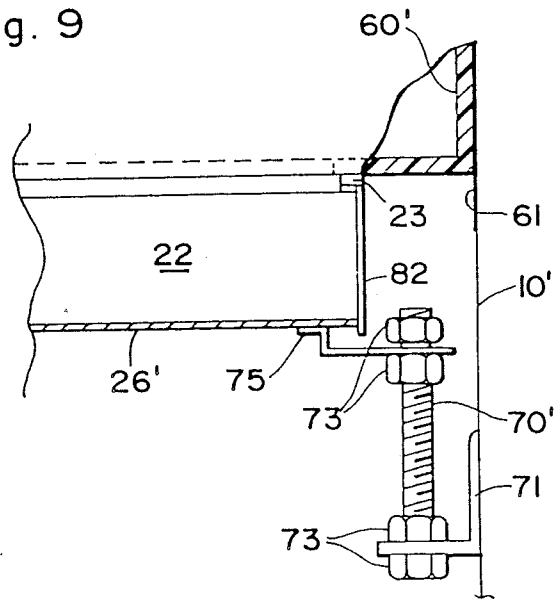
FIG. 9 is a partial sectional view of an alternative embodiment.
Figures 10A, 10B, 10C, 10D, 10E:
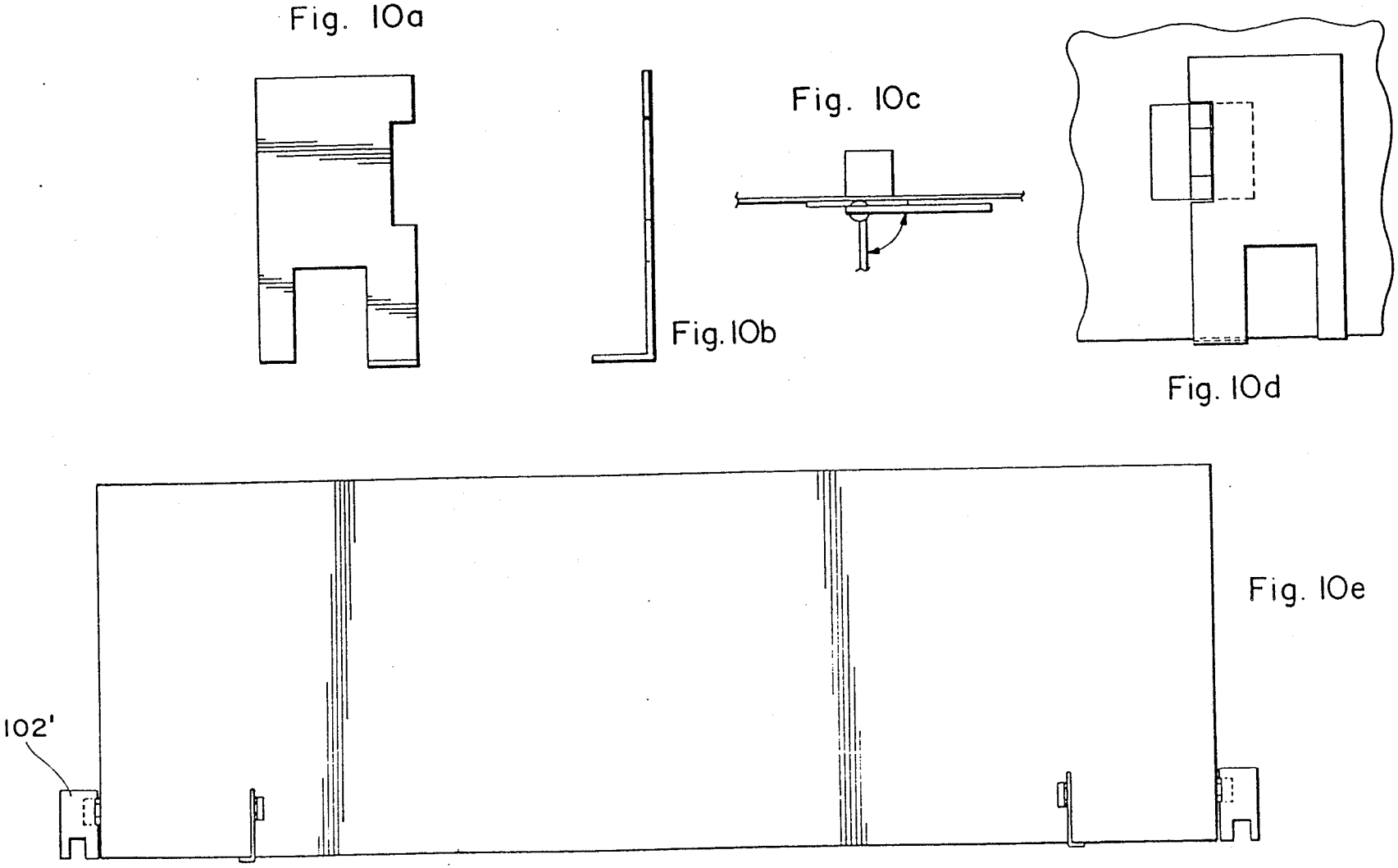
FIGS. 10(*a*)–10(*e*) show alternate embodiments of a mounting bracket.

A separate ground electrode 26 is provided on the downstream side of the filter element 22. Alternatively, the electrode may take the form of a perforated plate 26' as shown in FIG. 9 permanently sealed to the filter frame 82 in contact with the downstream face of the filter media, instead of the separate perforated electrode plate 26. Ground electrode 26 is placed in close proximity to and preferably in contact with the downstream face of the filter media. After passing through the ionizer 20, filter element 22 and ground electrode 26, the filtered air is exhausted out of the housing 10 through an inlet/outlet grill 28 which extends across the bottom of the housing 10. Inlet/outlet grill 28 also allows access to appropriate control switches 30 which may be provided for on-off and speed control. Inlet/outlet grill 28 is made detachable from housing 10 in order to allow access to the prefilter 12 and the filter element 22 for necessary filter changes. Further, the top cover 32 of the housing 10 is made removable for allowing access to the blower 14 power supply 24 and ionizer 20.

Figure 8:
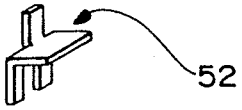
FIG. 8 is a perspective view of a prefilter retainer clip of the filtration unit of FIG. 2.
Figure 4:
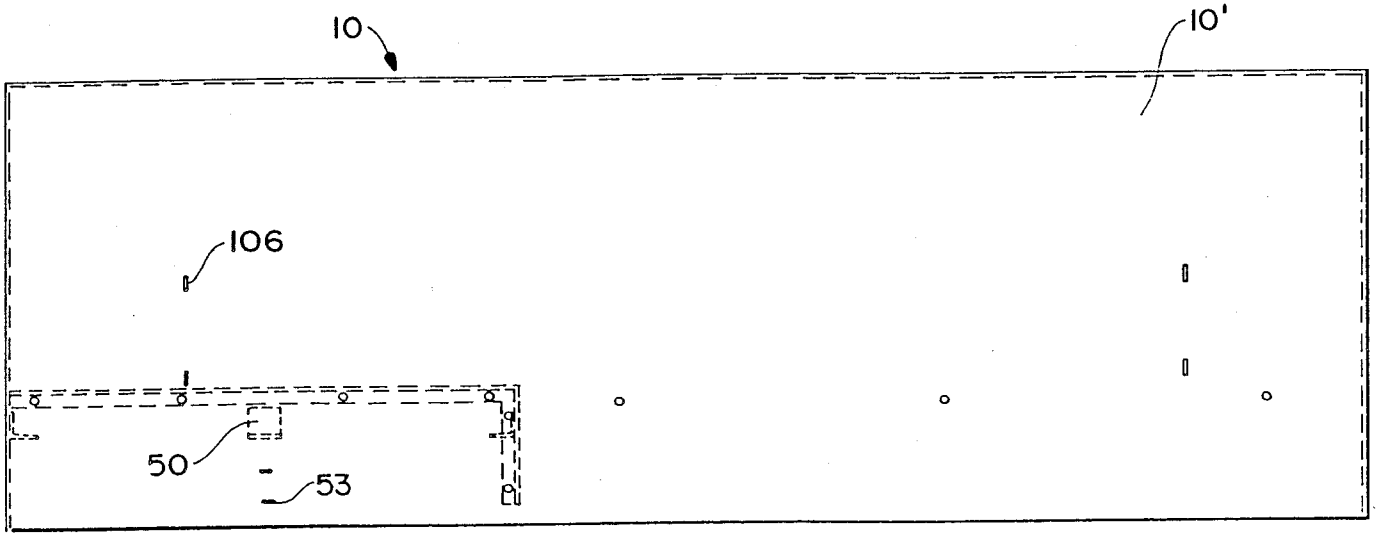
FIG. 4 is a front sectional view of a housing of the filtration unit of FIG. 2.

The prefilter 12 which is located in the housing 10 upstream of the blower 14 is provided in order to protect the blower and internal filter components from large size contaminant particles. The prefilter 12 is located in position by means of stops 50, and is held in position by means of removable retainer clips 52 as shown in FIGS. 2 and 8. As shown in FIG. 4, the side walls 10' of the housing 10 are provided with a number of slots 53 at spaced positions, thus allowing the retaining clips 52 to be positioned in appropriate ones of the slots 53 for accommodating different thicknesses of prefilters.

Figure 5:
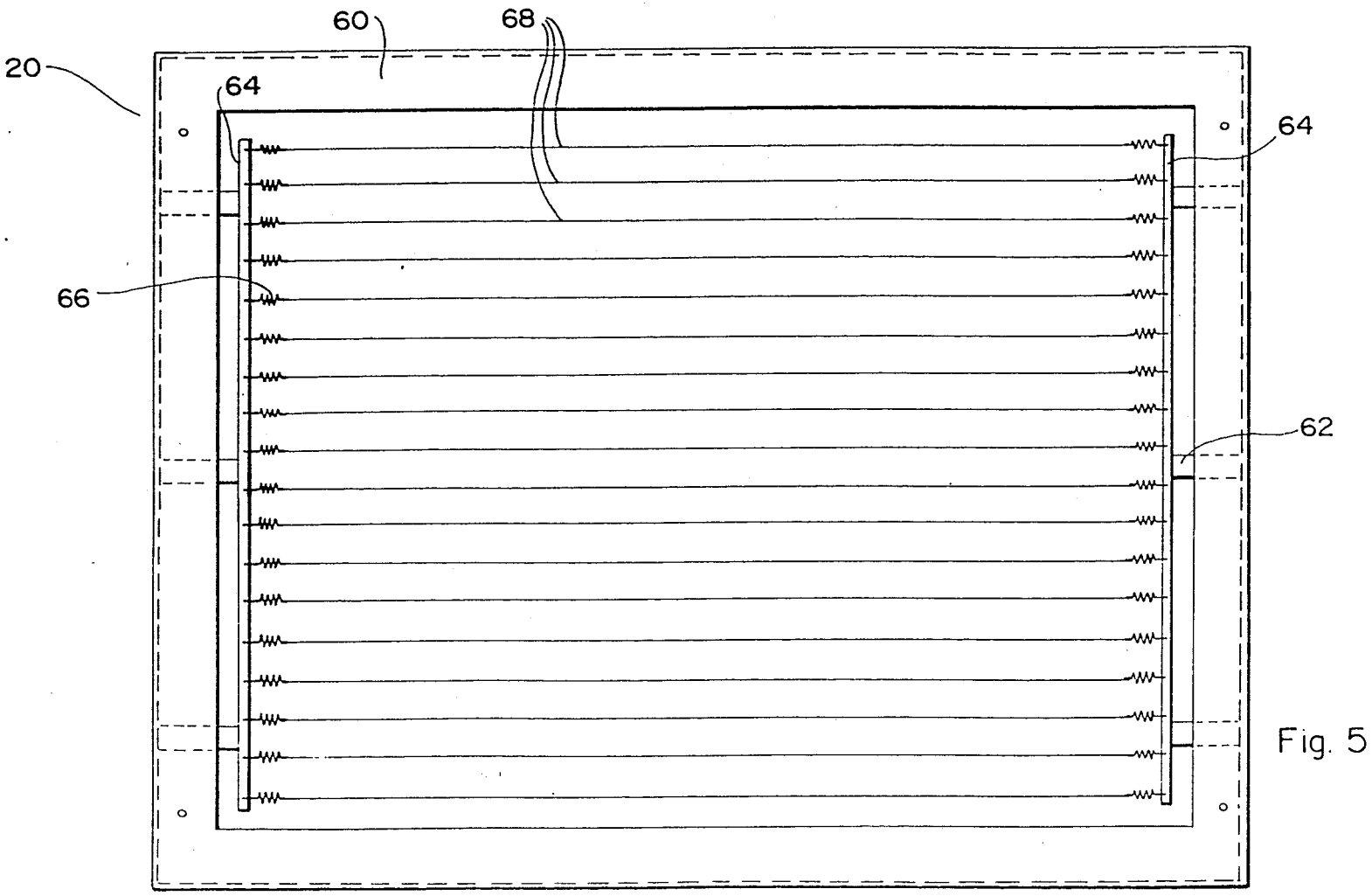
FIG. 5 is a front elevation view of an ionizer according to the present invention.
Figure 6A:
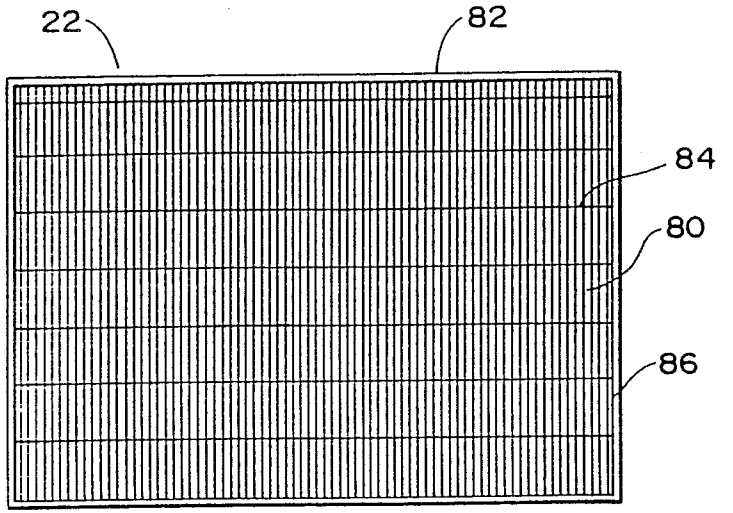
FIGS. 6(*a*)–6(*d*) show a filter assembly of an embodiment of the present invention, being respectively an elevation view, bottom view, sectional view and side elevation view thereof.
Figure 6B:
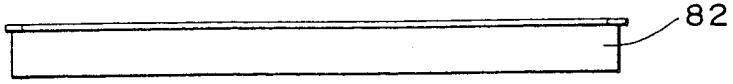
Figure 6C:
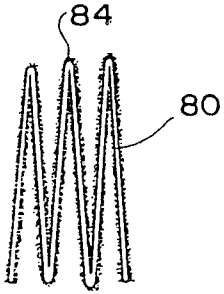
Figure 6D:
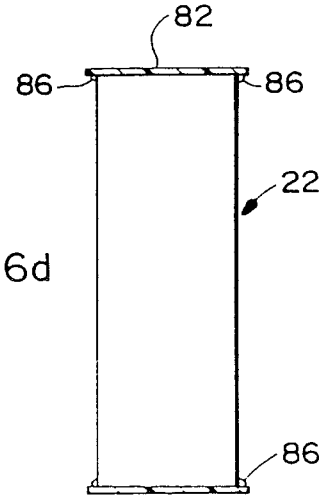

The ionizer assembly 20 is shown more particularly in FIG. 5. Ionizer assembly 20 includes a C-shaped plastic channel frame 60. Alternatively, an ionizer frame 60' of non-conductive profile such as an L-shaped angle form may be used, with one leg of the angle form serving as the downstream face of the ionizer assembly 20 as shown in FIG. 9. From opposite sides of the frame 60 (60') there extend inwardly a plurality of ceramic standoffs (insulators) 62 to which are mounted metal wire support brackets 64. Between the facing pair of support brackets 64 are mounted a plurality of metal springs 66 and ionizing wires 68. The plastic channel frame 60 provides a means for mounting the ionizer assembly 20 in the housing 10 as may be seen from FIG. 2. Moreover, the plastic channel frame 60 also acts as an electrical insulator and as a sealing surface for the filter element assembly 22, so that the filter element 22 may be conveniently sealed against the frame 60.

Typically, a sealant or adhesive is used to seal any leakage path between the housing 10 and plastic frame 60(60'). Also, it is preferred to apply a strip of non-conductive tape 61 to housing 10, and to mount the ionizer frame 60(60') onto the tape 61. The tape 61 is typically two inches wider than ionizer frame 60(60'), for optimum insulation. This mounting arrangement helps to supress leakage current that is not useful in increasing the efficiency of the filter.

With the ceramic standoffs 62 and metal wire support brackets 64 mounted inside the plastic frame 60, a series of spaced ionizing wires 68 are strung in tension across the ionizer frame 60 between the wire support brackets 64. An extension spring 56 is used on each end of each wire 68 in order to provide tensioning of the wire, thus holding the wires 68 tight and in place. The wires 68 are positioned in the plastic frame 60 relative to the sealing surface thereof with the filter assembly 22 in such manner as to provide the correct gap distance from the ionizer wires 68 to the ground electrode 26. This gap between the wires 68 and ground electrode 26 is critical for optimum performance and applied field strength. The output of the high voltage DC power supply 24 is directly connected to the ionizer wire assembly 20 by suitable connection (not shown).

The bottom or downstream side of the ionizer frame 60 is provided with a plurality of non-conductive (e.g., plastic) studs 70 by means of which the filter assembly 22 may be sealed tightly against the ionizer frame 60. Alternatively, bolts 70' can be mounted on metal angle clips 71 on the inside of the housing 10, separate from the ionizer frame 60(60') as shown in FIG. 9. A ground connection is made to the filter ground electrode 26 which is described in detail below, by means of a wire connector. If angle clips 71 are utilized, the clips 71, bolts 70', nuts 73 and pivotable retainer clips 75 of metal can provide a ground connection from electrode 26 to housing 10, or to the power supply 24.

The filter assembly 22 is made of pleated filter media 80, for example, HEPA glass sheeting, and includes a plastic frame 82. The filter media 80 is arranged in pleats in order to present a high filter surface area, thus reducing the pressure drop across the filter (i.e., head loss). The spacing of the pleats may be provided and maintained by applying glue beads 84 (i.e., glue bead rows) along both surfaces of the filter media 80 as shown in FIG. 6 (*c*). Other means for spacing the pleats in the filter media 80 may be used so long as they are non-conductive, for example, adhesive ribbons applied across the filter faces.

The pleated filter media 80 (media pack) is placed in the plastic frame 82, and the outside edges of the media pack are sealed to the frame 82 by, for example, a bead 86 of hot melt glue on both the upstream and downstream sides of the filter assembly 22. This method of assembly eliminates the necessity of mounting the filter media 80 in a C-shaped channel frame and then plotting or otherwise filling up the C-shaped channel. The plastic frame 82 of the filter assembly 22 helps to isolate the high voltage ionizer from the metal components in the housing 10.

The perforated ground electrode 26 may be glued to the filter assembly during attachment of the filter media 80 to plastic frame 80. Alternatively, ground electrode 26 may be a separate reusable component.

Figure 7:
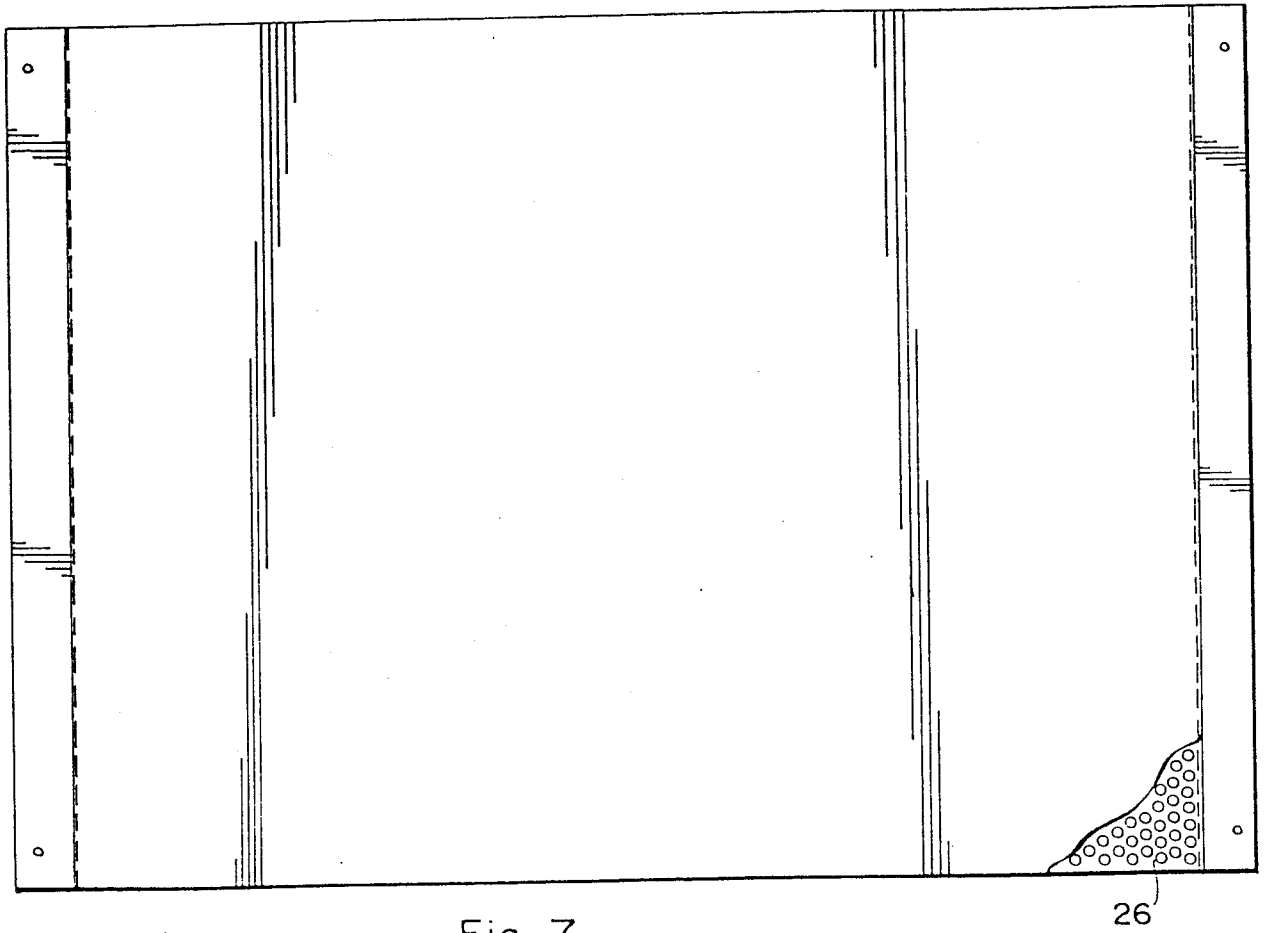
FIG. 7 is a front elevation view of a ground electrode of an embodiment of the present invention.

The reusable filter ground electrode 26 is shown in more detail in FIG. 7. The ground electrode 26 is separate from the filter assembly 22. The ground electrode 26 provides a filter outlet ground while also holding the the filter assembly 22 in sealing position against the ionizer assembly frame 60. The ground electrode 26 is brought into close proximity to, and preferably in contact with the pleated filter media 80, since this is required for optimal performance. Since, as noted, the ground electrode 26 is provided separate and independent from the filter assembly 22, it is not necessary to replace the ground electrode 26 when the filter assembly 22 is changed.

For sealing against air leakage and for spacing apart the ionizer and filter, a seal gasket 23 may be provided between the downstream face of ionizer frame 60 and the upstream face of filter frame 82 as in FIG. 9.

As will be readily appreciated, in the above-described embodiment the relation between the ionizing wires 68, filter media 80 and ground electrode 26 is such that a single ionizing field is produced between the ionizing wires 68 and ground electrode 26, with the filter element 22 being positioned optimally within this field. Further, it should be noted that the ionizing wires 68 are separated from the upstream face of the filter element pleated media 80 by an air gap "G", for example approximately 0.75 inch, as may be clearly seen from FIG. 2. Also it should be noted that the ground electrode 26 is placed in contact with or in close proximity to the downstream face of the filter element media 80. By placing the filter media 80 in contact with the perforated ground electrode 26 and by spacing the ionizing wires 68 apart from the filter media 80 to provide the ionizer-media gap "G", a significant enhancement in filter efficiency can be obtained while utilizing only a single electrical field in accordance with the present invention.

Figure 3C:
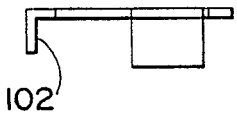
FIGS. 3(*a*), 3(*b*) and 3(*c*) are, respectively, a front elevation, side elevation and top view of a housing mounting bracket utilized in mounting the filtration unit of FIG. 2.
Figure 3A:
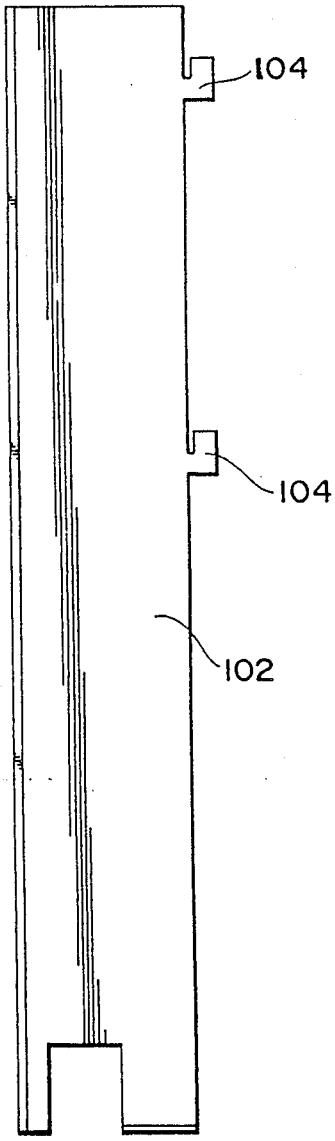
Figure 3B:
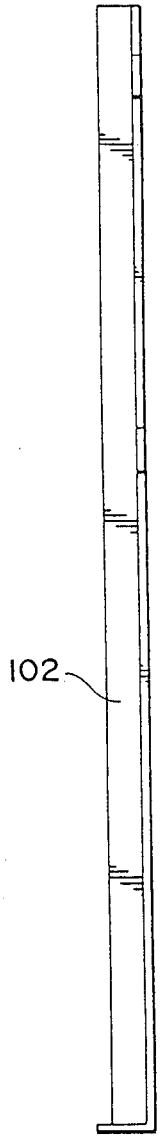

In the disclosed embodiment of FIGS. 2–8, before mounting the housing 10 a T-bar false ceiling frame 100 would typically be suspended from the true ceiling. Then, the housing 10 would be raised above the false ceiling T-bar frame 100, and housing mounting brackets 102 would be attached to each side of the housing 10, as shown in FIGS. 2–4. The mounting brackets 102 are provided with mounting tabs 104 which slip into slots 106 located in the side walls 10' of the housing 10. The housing 10, with mounting brackets 102 attached, is then lowered onto the T-bar frame 100 as in FIG. 2. Advantageously, the housing mounting brackets 102 also serve as a means for mounting the inlet/outlet grill 28 to the housing 10.

Figure 11:
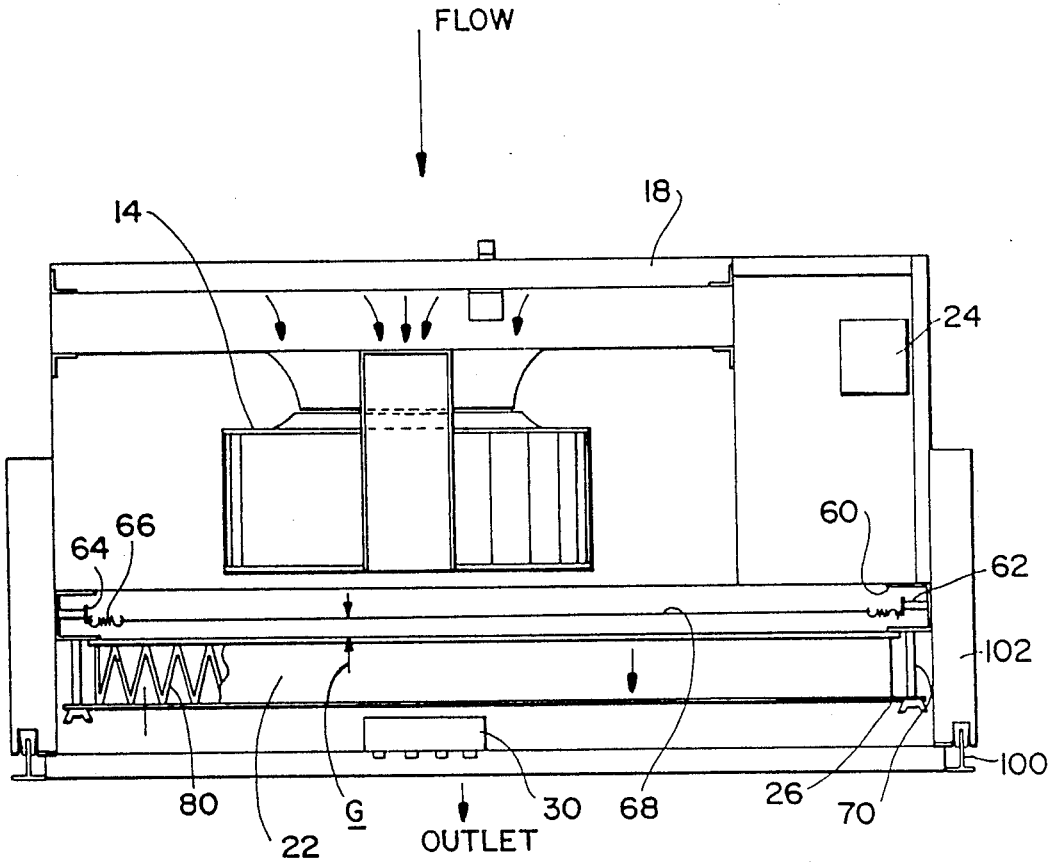
FIG. 11 is a sectional view of an alternative embodiment of an IESF wherein the inlet and outlet are in line, and ducted.

Alternatively, to facilitate ceiling installation of the unit, hinged mounting brackets 102' can be fastened to housing 10 in place of brackets 102, as shown in FIGS. 11(*a*)–11(*e*). The hinged mounting brackets 102' can be swung out from the housing 10 for engaging ceiling frame 100.

It will be readily appreciated that the single field ionizing electrically stimulated filter according to the present invention is amenable to various modifications and embodiments. For example, the IESF according to the present invention may be embodied in a duct, hood or other site as appropriate for a desired filtration application An example of a ducted unit is shown in FIG. 11. Either the inlet or outlet, or both, may be ducted. Other modifications are well within the ordinary skill of the art without departing from the scope of the present invention which is intended to be limited only by the appended claims.

What is claimed is:

1. A method for electrically stimulating a non-conductive dielectric media filter, comprising:

providing a first electrode spaced apart from an upstream face of a non-conductive dielectric pleated flat sheet glass media filter;

holding apart the pleats of said media filter by non-conductive pleat spacing means;

providing a second electrode closely proximate a downstream face of said media filter so as to be in at least loose contact with said downstream face;

drawing intake air through said media filter; and applying first and second high voltage potentials to the first and second electrodes, respectively, for maintaining a single ionizing and charging electrical field therebetween for ionizing said indrawn air and for charging particles and polarizing the media filter with a differential charge between the upstream and downstream faces thereof.

2. A single field ionizing electrically stimulated filter, comprising:

a non-conductive dielectric filter means having an upstream face and a downstream face, for trapping particulate matter from intake air drawn therethrough, said filter means comprising a pleated glass filter medium in flat sheet form having the pleats thereof held spaced apart by non-conductive pleat spacing means;

an ionizer means spaced apart from the upstream face of the filter means and adapted to be maintained at a high voltage potential;

an electrode means in close proximity to the downstream face of the filter means, the electrode means being adapted to be maintained at a second voltage potential differing from said first high voltage potential; and means for applying said first and second high voltage potentials to said ionizer means and said electrode means, respectively;

whereby an ionizing and charging electrical field is created between the ionizer means and electrode means under application of said respective first and second high voltage potentials thereto, for charging particulate matter therebetween and for charging and polarizing the filter means with a charge differential between said upstream and downstream faces thereof.

3. A single field ionizing electrically stimulated filter according to claim 2, wherein the filter means comprises glass filter medium in flat sheet form.

4. A single field ionizing electrically stimulated filter according to claim 2, wherein the pleat spacing means comprises glue beads applied across the upstream and downstream faces of the pleated filter medium.

5. A single field ionizing electrically stimulated filter according to claim 2, wherein the pleat spacing means comprises non-conductive adhesive ribbon applied across the upstream and downstream faces of the pleated filter medium.

6. A single field ionizing electrically stimulated filter according to claim 2, wherein the filter means further comprises a non-conductive filter frame, the filter medium being sealed along outside edges thereof to said filter frame.

7. A single field ionizing electrically stimulated filter according to claim 2, wherein the electrode means comprises a perforated metal plate.

8. A single field ionizing electrically stimulated filter according to claim 2, wherein the electrode means contacts the downstream face of the filter means.

9. A single field ionizing electrically stimulated filter according to claim 2, wherein the electrode means comprises a perforated metal plate permanently joined to the downstream face of the filter means.

10. A single field ionizing electrically stimulated filter according to claim 2, wherein the ionizer means comprises:

a non-conductive ionizer frame;

a plurality of ceramic insulator standoffs mounted to opposing inner faces of said ionizer frame;

metal support brackets supported on said ceramic insulator standoffs, the metal support brackets being adapted for connection with a high voltage potential supply source; and a plurality of spaced-apart ionizer wire assemblies extending across the ionizer frame between said metal support brackets, said ionizer wire assemblies being spaced back from a downstream face of the ionizer frame.

11. A single field ionizing electrically stimulated filter according to claim 10, wherein the ionizer frame is of non-conductive C-shaped channel.

12. A single field ionizing electrically stimulated filter according to claim 10, wherein the ionizer frame is of non-conductive L-shaped angle.

13. A single field ionizing electrically stimulated filter according to claim 10, wherein the non-conductive ionizer frame is provided on a downstream side thereof with electrode mounting means for mounting the filter means and electrode means thereto.

14. A single field ionizing electrically stimulated filter according to claim 10, wherein said ionizer wire assemblies each include an ionizer wire in series with an extension spring.

15. A single field ionizing electrically stimulated filter according to claim 14, wherein said ionizer wires are of tungsten.

16. A single field ionizing electrically stimulated filter, comprising:

a housing means having an inlet and an outlet and providing a plenum compartment therebetween.

a blower means mounted in said housing for drawing intake air thereinto and discharging the indrawn intake air into said plenum compartment;

a non-conductive dielectric filter means mounted on an outlet of said plenum compartment and having an upstream face and a downstream face, said filter means comprising a pleated glass filter medium in flat sheet form having the pleats thereof held spaced apart by non-conductive plea spacing means;

an ionizer means spaced apart from the upstream face of the filter means and adapted to be maintained at a first high voltage potential;

an electrode means in close proximity to the downstream face of the filter means, the electrode means being adapted to be maintained at a second high voltage potential differing from said first high voltage potential; and means for applying said first and second high voltage potentials to said ionizer means and said electrode means, respectively;

whereby an ionizing and charging electrical field is created between the ionizer means and electrode means under application of said respective first and second high voltage potentials thereto, for charging particulate matter in the indrawn intake air therebetween and for charging and polarizing the filter means with a differential charge between said upstream and downstream faces thereof.

17. A single field ionizing electrically stimulated filter according to claim 16, wherein the pleat spacing means comprises glue beads applied across the upstream and downstream faces of the pleated filter medium.

18. A single field ionizing electrically stimulated filter according to claim 16, wherein the pleat spacing means comprises non-conductive adhesive ribbon applied across the upstream and downstream faces of the pleated filter medium.

19. A single field ionizing electrically stimulated filter according to claim 16, wherein the filter means further comprises a non-conductive filter frame, the filter medium being sealed along outside edges thereof to said filter frame.

20. A single field ionizing electrically stimulated filter according to claim 16, wherein the electrode means comprises a perforated metal plate.

21. A single field ionizing electrically stimulated filter according to claim 16, wherein the electrode means contacts the downstream face of the filter means.

22. A single field ionizing electrically stimulated filter according to claim 16, wherein the electrode means comprises a perforated metal plate permanently joined to the downstream face of the filter means.

23. A single field ionizing electrically stimulated filter according to claim 16, further comprising a prefilter means mounted at the inlet of the housing means, for removing large size contaminant particles from the indrawn intake air.

24. A single field ionizing electrically stimulated filter according to claim 23, wherein the prefilter means is held in position against prefilter stop means fixedly mounted in said housing by adjustable retainer clips, whereby different thicknesses of prefilter means can be accommodated.

25. A single field ionizing electrically stimulated filter according to claim 29 wherein the ionizer frame is of non-conductive C-shaped channel.

26. A single field ionizing electrically stimulated filter according to claim 29, wherein the ionizer frame is of non-conductive L-shaped angle.

27. A single field ionizing electrically stimulated filter according to claim 16, wherein the non-conductive ionizer frame is provided on a downstream side thereof with electrode mounting means for mounting the filter means and electrode means thereto.

28. A single field ionizing electrically stimulated filter according to claim 16, wherein edges of the ionizer frame are electrically insulated from the housing means by non-conductive tape therebetween.

29. A single field ionizing electrically stimulated filler according to claim 16, wherein the ionizer means, comprises:

a non-conductive ionizer frame;

a plurality of ceramic insulator standoffs mounted to opposing inner faces of said ionizer frame;

metal support brackets supported of said ceramic insulator standoffs, the metal support brackets being adapted for connection with a high voltage potential supply source; and a plurality of spaced-apart ionizer wire assemblies extending across the ionizer frame between said metal support brackets, said ionizer wire assemblies being spaced back from a downstream face of the ionizer frame.

30. A single field ionizing electrically stimulated filter according to claim 29, wherein said ionizer wire assemblies each include an ionizer wire in series with an extension spring.

31. A single field ionizing electrically stimulated fi1ter according to claim 30, wherein said ionizer wires are of tungsten.

* * * * *